US012637836B2

(12) United States Patent
Hiranuma

(10) Patent No.: US 12,637,836 B2
(45) Date of Patent: May 26, 2026

(54) WORK MACHINE

(71) Applicant: SUMITOMO HEAVY INDUSTRIES, LTD., Tokyo (JP)

(72) Inventor: Kazunori Hiranuma, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 455 days.

(21) Appl. No.: 18/305,648

(22) Filed: Apr. 24, 2023

(65) Prior Publication Data

US 2023/0257961 A1 Aug. 17, 2023

Related U.S. Application Data

(63) Continuation of application No. PCT/JP2021/043852, filed on Nov. 30, 2021.

(30) Foreign Application Priority Data

Nov. 30, 2020 (JP) ..... 2020-198907

(51) Int. Cl.
*E02F 3/32* (2006.01)
*E02F 9/12* (2006.01)

(52) U.S. Cl.
CPC ..... *E02F 9/123* (2013.01); *E02F 3/32* (2013.01)

(58) Field of Classification Search
CPC ..... E02F 3/32; E02F 9/123
See application file for complete search history.

(56) References Cited

U.S. PATENT DOCUMENTS

| | | | |
|---|---|---|---|
| 2017/0107697 | A1 | 4/2017 | Kawashima |
| 2020/0024831 | A1 | 1/2020 | Okada et al. |
| 2020/0115882 | A1 | 4/2020 | Sano et al. |
| 2021/0163267 | A1 | 6/2021 | Yuzawa et al. |
| 2022/0010530 | A1 | 1/2022 | Yamamoto |

FOREIGN PATENT DOCUMENTS

| | | | | |
|---|---|---|---|---|
| JP | 2011-201678 | | 10/2011 | |
| JP | 2016166505 | A * | 9/2016 | ..... E02F 3/32 |
| JP | 2018-145754 | | 9/2018 | |
| JP | 2019-167731 | | 10/2019 | |
| JP | 2020-165268 | | 10/2020 | |
| WO | 2016/002850 | | 1/2016 | |
| WO | 2018/180555 | | 10/2018 | |
| WO | WO-2019078077 | A1 * | 4/2019 | ..... E02F 9/2296 |
| WO | 2020/022454 | | 1/2020 | |

OTHER PUBLICATIONS

International Search Report for PCT/JP2021/043852 mailed on Feb. 8, 2022.

* cited by examiner

*Primary Examiner* — Matthew R Buck
(74) *Attorney, Agent, or Firm* — IPUSA, PLLC

(57) ABSTRACT

A work machine includes a lower structure, a slewing upper structure attached to the lower structure via a slewing mechanism, an attachment, including at least a boom, and attached to the slewing upper structure, a boom cylinder configured to drive the boom, a work tool attached to the attachment, and a controller. The controller includes a weight calculating part configured to measure a weight of a transporting object to be transported by the work tool, based on a boom cylinder pressure of the boom cylinder, and a vibration control part configured to generate a command for reducing vibration of the attachment.

9 Claims, 9 Drawing Sheets

WORK MACHINE

CROSS REFERENCE TO RELATED APPLICATIONS

This application is a continuation application of International Application No. PCT/JP2021/043852 filed on Nov. 30, 2021 and designated the U.S., which is based upon and claims priority to Japanese Patent Application No. 2020-198907, filed on Nov. 30, 2020, the entire contents of each of which are hereby incorporated by reference.

BACKGROUND

1. Technical Field

The present disclosure relates to work machines having a work tool provided on a tip end thereof.

2. Description of the Related Art

As an example, Japanese Laid-Open Patent Publication No. 2011-201678 describes a load measuring device for a work machine that is provided with a lifting magnet configured to attract scraps, wherein the load measuring device includes a load measuring means for measuring a load of the scrap. Japanese Laid-Open Patent Publication No. 2011-201678 also describes that, in a case where an actual overturning moment exceeds an overturning moment specified by a rated load curve, further enlargement of a working radius is restricted.

In the work machine provided with the lifting magnet, when a lifting load (transporting object), such as scrap iron or the like, is attracted and lifted by the lifting magnet, vibration may be generated in an attachment (boom) of the work machine. This is because, in the work machine provided with the lifting magnet, the vibration is generated in the attachment (boom) due to a weight of the lifting magnet provided at a tip end of the attachment and a weight of the lifting load that are large. In addition, during a work of the work machine provided with the lifting magnet, the lifting load located at a position away from a slewing upper structure may be lifted and transported. In this case, the vibration is generated in the attachment (boom) because the lifting load is lifted in a state where the attachment is extended. Hence, a boom cylinder pressure vibrates due to the vibration generated in the attachment (boom). For this reason, when the weight of the lifting load is detected based on the boom cylinder pressure, it may not be possible to suitably measure the weight of the lifting load.

SUMMARY

One object according to one aspect of embodiments of the present disclosure is to provide a work machine that can accurately calculate a weight of a transporting object.

According to one aspect of the embodiments of the present disclosure, a work machine includes a lower structure; a slewing upper structure attached to the lower structure via a slewing mechanism; an attachment, including at least a boom, and attached to the slewing upper structure; a boom cylinder configured to drive the boom; a work tool attached to the attachment; and a controller, wherein the controller includes a storage device configured to store a program, and a processor configured to execute the program to perform a process including calculating a weight of a transporting object to be transported by the work tool, based on a boom cylinder pressure of the boom cylinder, and generating a command for reducing vibration of the attachment.

DETAILED DESCRIPTION

Hereinafter, embodiments for carrying out the invention of the present disclosure will be described with reference to the drawings.

<Outline of Work Machine>

Figure 1:
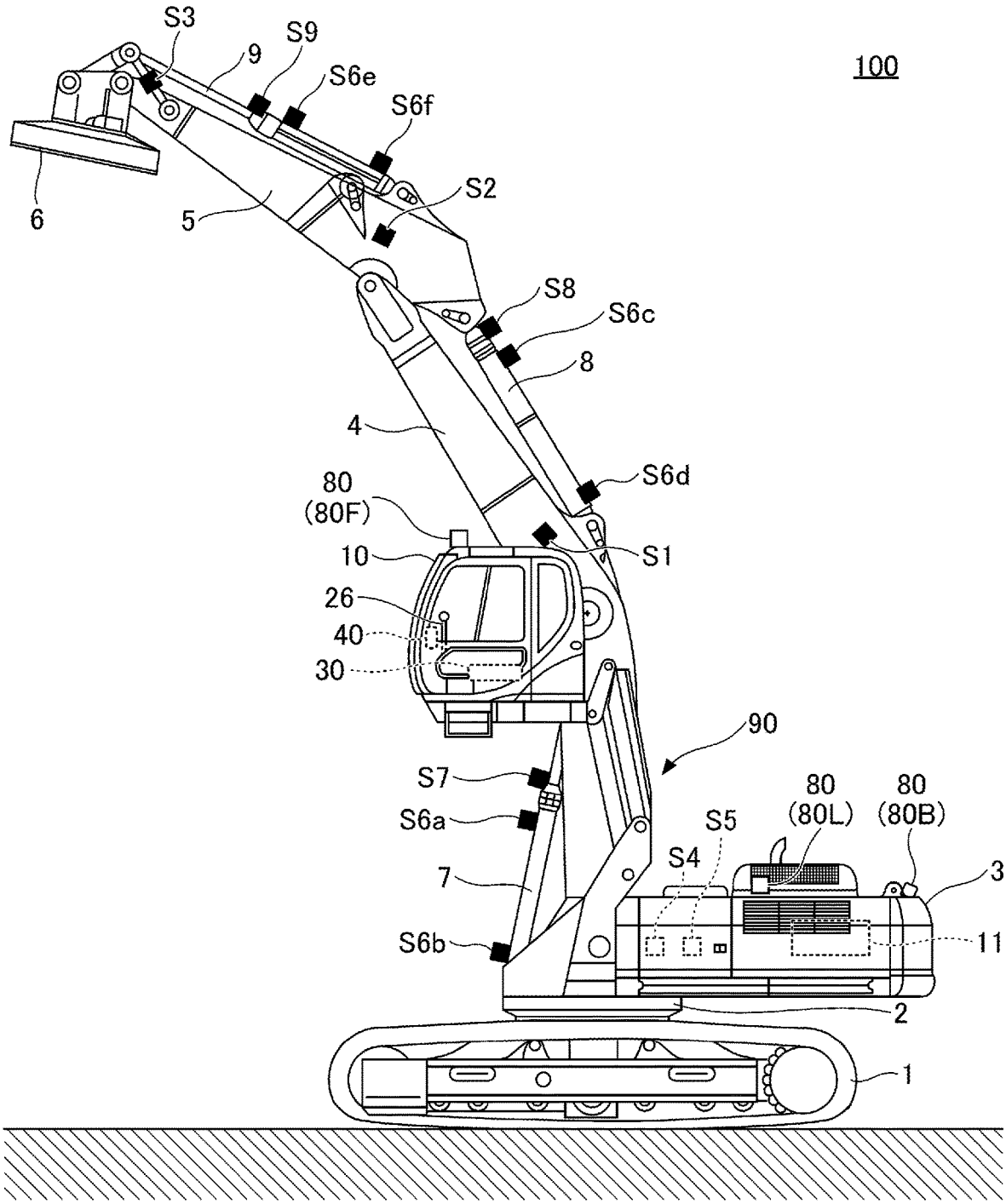
FIG. 1 is a side view of a work machine according to one embodiment.

FIG. 1 is a side view of a work machine 100 according to one embodiment. A slewing upper structure 3 is attached to a lower structure 1 of the work machine 100 via a slewing mechanism 2. A boom 4 is attached to the slewing upper structure 3. An arm 5 is attached to a tip end of the boom 4, and a lifting magnet 6 is attached to a tip end of the arm 5, as an end attachment (work tool). The boom 4 and the arm 5 form a work attachment which is an example of an attachment. The boom 4 is driven by a boom cylinder 7, the arm 5 is driven by an arm cylinder 8, and the lifting magnet 6 is driven by a lifting magnet cylinder 9. In the present embodiment, the work tool (transport mechanism) attached to the tip of the attachment, usable to transport a transporting object, is the lifting magnet 6. However, other work tools, such as a bucket for excavating and transporting soil or the like, a grapple, a demolition fork, a harvester including a chain saw, or the like may be attached, depending on a type of work.

A boom angle sensor S1 is attached to the boom 4, an arm angle sensor S2 is attached to the arm 5, and a lifting magnet angle sensor S3 is attached to the lifting magnet 6. A controller 30, a display device 40, a space recognition device 80, a body inclination sensor S4, and a swing angular velocity sensor S5 are attached to the slewing upper structure 3.

The boom angle sensor S1 is configured to detect a boom angle, which is a rotation angle of the boom 4 with respect to the slewing upper structure 3. The boom angle sensor S1 may be a rotation angle sensor that detects the rotation angle of the boom 4 around a boom foot pin, a cylinder stroke sensor that detects an amount of stroke (amount of boom stroke) of the boom cylinder 7, an inclination (acceleration) sensor that detects an inclination angle of the boom 4, a combination of an acceleration sensor and a gyro sensor, or the like, for example. The same applies to the arm angle sensor S2 that detects an arm angle, which is a rotation angle of the arm 5 with respect to the boom 4, and the lifting magnet angle sensor S3 that detects a lifting magnet angle, which is a rotation angle of the lifting magnet 6 with respect to the arm 5.

The body inclination sensor S4 is configured to detect an inclination (body inclination angle) of the slewing upper structure 3 with respect to a horizontal plane. In the present embodiment, the machine body inclination sensor S4 is an acceleration sensor that detects the inclination angle of the slewing upper structure 3 around a longitudinal axis and a lateral axis. The longitudinal axis and the lateral axis of the slewing upper structure 3 are orthogonal to each other, and pass through a machine center which is a point on a swing axis of the work machine 100.

The swing angular velocity sensor S5 detects a swing angular velocity of the slewing upper structure 3. In the present embodiment, the swing angular velocity sensor S5 is a gyro sensor, but the swing angular velocity sensor S5 may be a resolver, a rotary encoder, or the like.

The space recognition device 80 is configured to capture an image of a surrounding of the work machine 100. The space recognition device 80 is a monocular camera, a stereo camera, a distance image camera, an infrared camera, a LIDAR, or the like, for example. In the example illustrated in FIG. 1, the space recognition device 80 includes a front camera 80F attached to a front end of an upper surface of the slewing upper structure 3, a back camera 80B attached to a back end of the upper surface of the slewing upper structure 3, a left camera 80L attached to a left end of the upper surface of the slewing upper structure 3, and a right camera 80R (not visible in FIG. 1) attached to a right end of the upper surface of the slewing upper structure 3.

The space recognition device 80 is a monocular camera including an imaging element, such as a CCD, a CMOS, or the like, for example, and outputs a captured image to the display device 40. In addition, the space recognition device 80 may be configured to calculate a distance from the space recognition device 80 or the work machine 100 to a recognized object. When a millimeter-wave radar, an ultrasonic sensor, a laser radar, an ultrasonic sensor, a laser radar, or the like is utilized as the space recognition device 80, instead of merely utilizing the captured image, a large number of signals (laser beams or the like) can be transmitted to the object and reflected signals from the object can be received, so as to detect the distance and direction to the object from the reflected signals.

The space recognition device 80 is configured to detect the object present in the surrounding of the work machine 100. The object is a dump truck, a terrain shape (inclination, hole, or the like), an electric wire, a utility pole, a person, an animal, a vehicle, a construction machine, a building, a wall, a helmet, a safety vest, a work clothing, a predetermined mark on the helmet, or the like, for example. Hence, the space recognition device 80 may be configured to be able to identify at least one of a type, a position, a shape, or the like of the object. For example, the space recognition device 80 may be configured to be able to distinguish between the person and the object other than the person.

A boom rod pressure sensor S6*a*, a boom bottom pressure sensor S6*b*, and a boom cylinder stroke sensor S7 may be attached to the boom cylinder 7, as pressure sensors for the boom cylinder 7. An arm rod pressure sensor S6*c*, an arm bottom pressure sensor S6*d*, and an arm cylinder stroke sensor S8 may be attached to the arm cylinder 8, as pressure sensors for the arm cylinder 8. A lifting magnet rod pressure sensor S6*e*, a lifting magnet bottom pressure sensor S6*f*, and a lifting magnet cylinder stroke sensor S9 may be attached to the lifting magnet cylinder 9, as pressure sensors for the lifting magnet cylinder 9.

The boom rod pressure sensor S6*a* detects a pressure inside a rod-side fluid chamber (hereinafter referred to as "a boom rod pressure") of the boom cylinder 7, and the boom bottom pressure sensor S6*b* detects a pressure inside a bottom-side fluid chamber (hereinafter referred to as "a boom bottom pressure") of the boom cylinder 7. The arm rod pressure sensor S6*c* detects a pressure inside a rod-side fluid chamber (hereinafter referred to as "an arm rod pressure") of the arm cylinder 8, and the arm bottom pressure sensor S6*d* detects a pressure inside a bottom-side fluid chamber (hereinafter referred to as "an arm bottom pressure") of the arm cylinder 8. The lifting magnet rod pressure sensor S6*e* detects a pressure inside a rod-side fluid chamber (hereinafter referred to as "a lifting magnet rod pressure") of the lifting magnet cylinder 9, and the lifting magnet bottom pressure sensor S6*f* detects a pressure inside a bottom-side fluid chamber (hereinafter referred to as "a lifting magnet bottom pressure") of the lifting magnet cylinder 9.

The slewing upper structure 3 is provided with a cab 10, as a driver's cab, and is provided with a power source, such as an engine 11 or the like.

Further, a cab 10 is provided on the slewing upper structure 3, so that the cab 10 can be raised and lowered via a cab elevator device 90. Hereinafter, a cab that can be raised and lowered in this manner may also be referred to as "an elevator cab". FIG. 1 illustrates a state where the cab 10 is raised to a highest position by the cab elevator device 90. In addition, the cab 10 is disposed on a side (generally on a left side) of the boom 4.

Figure 2:
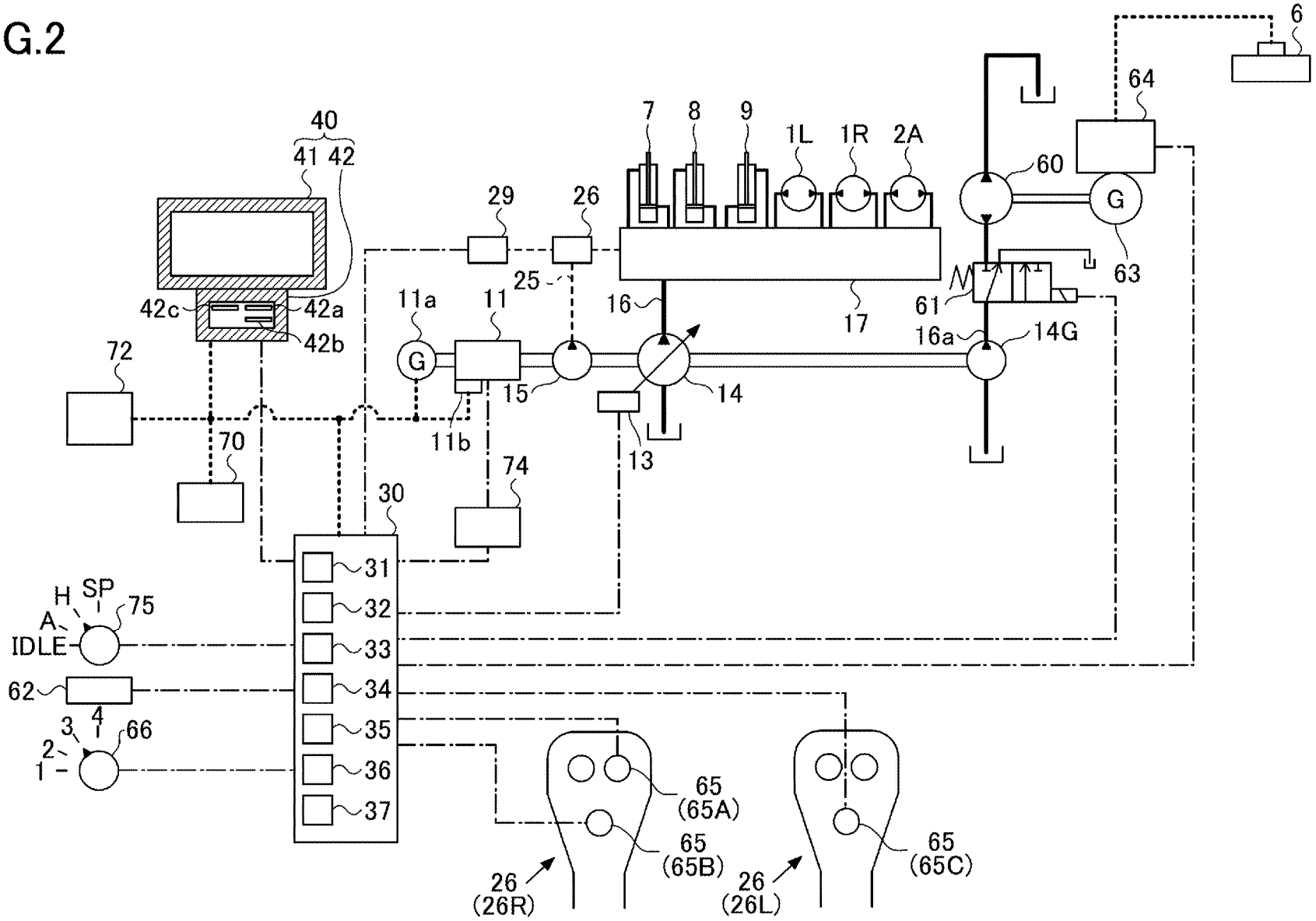
FIG. 2 is a block diagram illustrating a configuration example of a driving system attached to the work machine illustrated in FIG. 1.

FIG. 2 is a diagram illustrating a configuration example of a driving system attached on the work machine 100. In FIG. 2, a mechanical power transmission system is indicated by a double line, a working fluid line is indicated by a bold solid line, a pilot line is indicated by a broken line, an electric control system is indicated by a one-dot chain line, and an electric driving system is indicated by a bold dotted line.

The driving system of the work machine 100 mainly includes the engine 11, a main pump 14, a hydraulic pump 14G, a pilot pump 15, a control valve 17, an operation device 26, a controller 30, and an engine controller 74.

The engine 11 is a power source of the work machine 100, and is a diesel engine that operates to maintain a predetermined engine speed, for example. An output shaft of the engine 11 is connected to input shafts of an alternator 11*a*, the main pump 14, the hydraulic pump 14G, and the pilot pump 15.

The main pump 14 supplies a working fluid to the control valve 17 via a working fluid line 16. In the present embodiment, the main pump 14 is a swash plate type variable displacement hydraulic pump.

A regulator 13 controls a discharge amount of the main pump 14. In the present embodiment, the regulator 13 controls the discharge amount of the main pump 14 by adjusting a swash plate tilt angle of the main pump 14 according to a control signal or the like from the controller 30.

The pilot pump 15 supplies the working fluid to various hydraulic control devices including the operation device 26, via a pilot line 25. In the present embodiment, the pilot pump 15 is a fixed displacement hydraulic pump.

The control valve 17 is a hydraulic control device that controls a hydraulic system in the work machine 100. The control valve 17 selectively supplies the working fluid discharged from the main pump 14 to one or more elements selected from the boom cylinder 7, the arm cylinder 8, the lifting magnet cylinder 9, a left drive hydraulic motor 1L, a right drive hydraulic motor 1R, and a swing hydraulic motor 2A, for example. In the following description, the boom cylinder 7, the arm cylinder 8, the lifting magnet cylinder 9, the left drive hydraulic motor 1L, the right drive hydraulic motor 1R, and the swing hydraulic motor 2A are collectively referred to as "hydraulic actuators".

The operation device 26 is a device used by an operator to operate the hydraulic actuators. In the present embodiment, the operation device 26 generates a pilot pressure by supplying the working fluid from the pilot pump 15 to a pilot port of a corresponding flow control valve inside the control valve 17. More particularly, the operation device 26 includes a left operating lever for a swing operation and an arm operation, a right operating lever for a boom operation and a lifting magnet operation, a travel pedal, a travel lever (each of the levers and pedal not illustrated), or the like. The pilot pressure varies according to an operation content (including an operation direction and an operation amount, for example) of the operation device 26.

The operation pressure sensor 29 detects the pilot pressure generated by the operation device 26. In the present embodiment, the operation pressure sensor 29 detects the pilot pressure generated by the operation device 26, and outputs a detected value with respect to the controller 30. The controller 30 grasps operation contents of the operation device 26, based on the output of the operation pressure sensor 29.

The controller 30 is a control device that executes various calculations. In the present embodiment, the controller 30 is a microcomputer including a processor such as a CPU, a volatile storage device, a nonvolatile storage device, or the like. For example, the controller 30 reads programs corresponding to various functions from the nonvolatile storage device, loads the read programs into the volatile storage device, and causes the CPU to execute processes corresponding to the programs, respectively.

The hydraulic pump 14G supplies the working fluid to a hydraulic motor 60 via a working fluid line 16*a*. In the present embodiment, the hydraulic pump 14G is a fixed displacement hydraulic pump, and supplies the working fluid to the hydraulic motor 60 via a directional control valve 61.

The directional control valve 61 is configured to switch a flow of the working fluid discharged from the hydraulic pump 14G. In the present embodiment, the directional control valve 61 is a solenoid valve having valve positions that are switched according to a control command from the controller 30. The directional control valve 61 has a first valve position for enabling communication between the hydraulic pump 14G and the hydraulic motor 60, and a second valve position for cutting off the communication between the hydraulic pump 14G and the hydraulic motor 60.

When a mode selector switch 62 is operated to switch an operation mode of the work machine 100 to a lifting magnet mode, the controller 30 outputs a control signal with respect to the directional control valve 61 to switch the directional control valve 61 to the first valve position. When the mode selector switch 62 is operated to switch the operation mode of the work machine 100 to a mode other than the lifting magnet mode, the controller 30 outputs a control signal with respect to the directional control valve 61 to switch the directional control valve 61 to the second valve position. FIG. 2 illustrates a state where the directional control valve 61 is in the second valve position.

The mode selector switch 62 is a switch for switching the operation mode of the work machine 100. In the present embodiment, the mode selector switch 62 is a rocker switch provided inside the cab 10. The operator operates the mode selector switch 62 to select one of a shovel mode and the lifting magnet mode. The shovel mode is an operation mode in which the work machine 100 is operated as an excavator (shovel), and is selected when a bucket is attached to the tip end of the arm 5 in place of the lifting magnet 6, for example. The lifting magnet mode is a mode in which the work machine 100 is operated as a work machine with the lifting magnet, and is selected when the lifting magnet 6 is attached to the tip end of the arm 5. The controller 30 may automatically switch the operation mode of the work machine 100 based on the outputs of the various sensors.

In a case where the lifting magnet mode is selected, the directional control valve 61 is set to the first valve position, to cause the working fluid discharged from the hydraulic pump 14G to flow into the hydraulic motor 60. On the other hand, in a case where an operation mode other than the lifting magnet mode is selected, the directional control valve 61 is set to the second valve position, to cause the working fluid discharged from the hydraulic pump 14G to flow out to a working fluid tank without flowing into the hydraulic motor 60.

A rotation shaft of the hydraulic motor 60 is mechanically coupled to a rotation shaft of a generator 63. The generator 63 generates electric power for exciting the lifting magnet 6. In the present embodiment, the generator 63 is an AC generator that operates according to a control command from a power controller 64.

The power controller 64 controls supply and cutoff of the electric power for exciting the lifting magnet 6. In the present embodiment, the power controller 64 controls a start and a stop of generation of AC electric power by the generator 63 according to a power generation start command and a power generation stop command from the controller 30. In addition, the power controller 64 converts the AC electric power generated by the generator 63 into DC electric power, and supplies the DC electric power to the lifting magnet 6. Further, the power controller 64 can control a magnitude of a voltage applied to the lifting magnet 6, and a magnitude of a current flowing through the lifting magnet 6.

When a lifting magnet switch 65 is turned on, the controller 30 outputs an attraction command to the power controller 64. The power controller 64 that receives the attraction command converts the AC electric power generated by the generator 63 into DC electric power, and supplies the DC electric power to the lifting magnet 6 so as to excite the lifting magnet 6. The excited lifting magnet 6 assumes an attracting state capable of attracting an object (magnetic body).

When the lifting magnet switch 65 is turned off, the controller 30 outputs a release command to the power controller 64. The power controller 64 that receives the release command causes the generator 63 to stop generating the power, and causes the lifting magnet 6 in the attracting state to assume a non-attracting state (released state). The released state of the lifting magnet 6 refers to a state where the supply of electric power to the lifting magnet 6 is stopped, and an electromagnetic force generated by the lifting magnet 6 is lost.

The lifting magnet switch 65 is a switch for switching between the attracting and released states of the lifting magnet 6. In the present embodiment, the lifting magnet switch 65 includes a weak excitation button 65A and a strong excitation button 65B that are provided as push button switches at a top of the left operating lever 26L, and a release button 65C that is provided as a push button switch at a top of the right operating lever 26R.

The weak excitation button 65A is an example of an input device for applying a predetermined voltage to the lifting magnet 6 to put the lifting magnet 6 into the attracting state (weak attracting state). The predetermined voltage is a voltage set through a magnetic force adjusting dial 66.

The strong excitation button 65B is an example of an input device for applying a tolerable maximum voltage to the lifting magnet 6 to put the lifting magnet 6 into the attracting state (strong attracting state).

The release button 65C is an example of an input device for putting the lifting magnet 6 into the released state.

The magnetic force adjusting dial 66 is a dial for adjusting the magnetic force (attraction force) of the lifting magnet 6. In the present embodiment, the magnetic force adjusting dial 66 is provided inside the cab 10, and is configured to be able to switch the magnetic force (attraction force) of the lifting magnet 6 in four stages when the weak excitation button 65A is pressed. More particularly, the magnetic force adjusting dial 66 is configured to be able to switch the magnetic force (attraction force) of the lifting magnet 6 in four stages, from a first level to a fourth level. FIG. 2 illustrates a state where a third level is selected by the magnetic force adjusting dial 66.

The lifting magnet 6 is controlled to generate a magnetic force (attraction force) at the level set by the magnetic force adjusting dial 66. The magnetic force adjusting dial 66 outputs data indicating the level of the magnetic force (attraction force) with respect to the controller 30.

According to this configuration, the operator can attract and release the object (magnetic body) by the lifting magnet 6 with a finger, while operating the left operating lever 26L with the left hand and operating the right operating lever 26R with the right hand to operate the work attachment. Typically, the operator presses the weak excitation button 65A in a state where the lifting magnet 6 is caused to make contact with the object (for example, scrap iron or the like) to attract the scrap iron onto the lifting magnet 6. Thereafter, the operator gradually raises the boom 4 to lift the lifting magnet 6 attracting the scrap iron, and then presses the strong excitation button 65B to increase the magnetic force (attraction force) of the lifting magnet 6. This is to prevent the scrap iron from falling from the lifting magnet 6 during transport of the scrap iron by an attachment operation (an operation including at least one of a boom operation, an arm operation, and a bucket operation) or a swing operation.

In addition, the operator can sort the objects by adjusting the magnetic force (attraction force) of the lifting magnet 6 using the magnetic force adjusting dial 66. The operator can selectively lift and move relatively light objects from a scrap heap using a relatively weak level of the magnetic force (attractive force) to sort the relatively light objects from relatively heavy objects, for example. This is because the operator can be prevented from lifting the relatively heavy objects by using the relatively weak level of the magnetic force (attraction force).

The work machine 100 may be configured to automatically switch the operation mode to a speed limit mode when the weak excitation button 65A or the strong excitation button 65B is pressed. The speed limit mode is an operation mode in which a swinging speed and a driving speed of the attachment are limited in the lifting magnet mode, for example.

Further, in a case where a predetermined operation is performed after the weak excitation button 65A is pressed, or in a case where a predetermined state is reached, the work machine 100 may automatically switch the state of the lifting magnet 6 to the strong attracting state which is the state that occurs when the strong excitation button 65B is pressed. The predetermined operation is a swing operation, for example. The predetermined state is a state where the attachment assumes a predetermined attitude, specifically, a state where the boom angle assumes a predetermined angle, for example. In this case, the work machine 100 can automatically switch the state of the lifting magnet 6 to the strong attracting state, even if the strong excitation button 65B is not pressed, when the swing operation is performed after the lifting magnet 6, that is in the weak attracting state by the pressing of the weak excitation button 65A, is lifted according to the boom raising operation, for example.

The display device 40 is a device that displays various information. In the present embodiment, the display device 40 is fixed on a pillar (not illustrated) at a right front portion of the cab 10 where a driver's seat is provided. In addition, as illustrated in FIG. 2, the display device 40 can display information related to the work machine 100 on an image display part 41 to provide the information to the operator. Moreover, the display device 40 includes a switch panel 42 as an input device. The operator can input various commands with respect to the controller 30, by utilizing the switch panel 42.

The switch panel 42 is a panel including various switches. In the present embodiment, the switch panel 42 includes a light switch 42*a*, a wiper switch 42*b*, and a window washer switch 42*c*, as hardware buttons. The light switch 42*a* is a switch for switching light, attached to the outside of cab 10, on and off. The wiper switch 42*b* is a switch for switching a windshield piper between operating and stopped states. The window washer switch 42*c* is a switch for spraying a window washer fluid.

The display device 40 operates by receiving power supply from a storage battery 70. The storage battery 70 is charged by electric power generated by the alternator 11*a*. The electric power of the storage battery 70 is also supplied to an electrical component 72 or the like other than the controller 30 and the display device 40. A starter 11*b* of the engine 11 is driven by the electric power from the storage battery 70, and starts the engine 11.

The engine controller 74 controls the engine 11. In the present embodiment, the engine controller 74 collects various data indicating the state of the engine 11, and transmits the collected data to the controller 30. Although the engine controller 74 and the controller 30 are configured as separate components, the engine controller 74 and the controller 30 may be configured integrally. For example, the engine controller 74 may be integrated into the controller 30.

An engine speed adjusting dial 75 is a dial for adjusting an engine speed. In the present embodiment, the engine speed adjusting dial 75 is provided inside the cab 10, and is configured to be able to switch the engine speed in four stages. More particularly, the engine speed adjusting dial 75 is configured to be able to switch the engine speed in four stages, including an SP mode, an H mode, an A mode, and an idle mode. FIG. 2 illustrates a state where the H mode is selected by the engine speed adjusting dial 75.

The SP mode is a rotation speed mode that is selected in a case where priority is to be given to an amount of work performed, and utilizes a highest engine speed. The H mode is a rotation speed mode that is selected in a case where emphasis is to be given to both the amount of work performed and a fuel consumption, and utilizes a second highest engine speed. The A mode is a rotation speed mode that is selected in a case where the work machine is to be operated with low noise while giving priority to the fuel consumption, and utilizes a third highest engine speed. The idle mode is a rotation speed mode that is selected in a case where the engine is to be operated in an idle state, and utilizes a lowest engine speed (idling speed).

The engine 11 is controlled so that the engine speed corresponding to the rotation speed mode set by the engine speed adjusting dial 75 is maintained. The engine speed adjusting dial 75 outputs data indicating a set state of the engine speed to the controller 30.

In addition, the controller 30 includes a target weight setting part 31, a weight calculating part 32, an attraction force control part 33, a maximum payload setting part 34, an accumulated weight calculating part 35, a remaining weight calculating part 36, and a vibration control part 37.

The target weight setting part 31 acquires a target weight of the object to be attracted by the lifting magnet 6. The target weight may be input by the operator, may be set based on a remaining weight calculated by the remaining weight calculating part 36 which will be described later, or may be preset.

The weight calculating part 32 calculates the weight (current weight) of the object attracted to the lifting magnet 6. The current weight is calculated from a balance of a torque around a bottom of the boom 4, for example. More particularly, a thrust of the boom cylinder 7 increases due to the object attracted to the lifting magnet 6, and the torque around the bottom of the boom 4, that is calculated from the thrust of the boom cylinder 7, also increases. An increment of the torque coincides with the torque calculated from a weight of the object and a center of gravity of the object. Hence, the weight calculating part 32 can calculate the weight of the object, based on the thrust of the boom cylinder 7 (measured values of the boom rod pressure sensor S6*a* and the boom bottom pressure sensor S6*b*) and the center of gravity of the object. The center of gravity of the object can be experimentally obtained in advance and stored in the controller 30, for example. A method of calculating the weight of the object is not limited to the method described above, and various other methods can be used to calculate the weight of the object.

The attraction force control part 33 controls the attraction force of the lifting magnet 6, by controlling a current command value of the current supplied to the lifting magnet 6.

The maximum payload setting part 34 sets a maximum payload of the dump truck on which the object is loaded. The maximum payload may be input by the operator, for example. Alternatively, a vehicle type (size or the like) of the dump truck may be determined based on a dump truck image captured by the space recognition device 80, and the maximum payload may be set based on the determined vehicle type (size or the like), for example.

The accumulated weight calculating part 35 calculates an accumulated weight of the object loaded on a load-carrying platform of the dump truck.

The remaining weight calculating part 36 calculates the remaining weight which is a difference between the maximum payload and the accumulated weight.

The vibration control part 37 generates and outputs a command for controlling vibration of the attachment.

Hereinafter, an example of the operation of the work machine 100 according to the present embodiment will be described.

First, the target weight setting part 31 of the controller 30 sets the target weight of the object to be attracted by the lifting magnet 6. The maximum payload setting part 34 sets the maximum payload of the dump truck on which the object is loaded.

Next, the operator operates the operation device 26 to move the lifting magnet 6 to a position above the object to be attracted.

Next, the operator operates the weak excitation button 65A, and causes the lifting magnet 6 to generate a magnetic force (attraction force). Thus, the object is attracted to the lifting magnet 6. In this state, the attraction force control part 33 of the controller 30 issues a first current command value, as the current command value. The first current command value is set to a sufficient current value so that the weight of the object attracted to the lifting magnet 6 can be greater than or equal to the target weight. The power controller 64 controls the current supplied to the lifting magnet 6, based on the current command value.

Next, the operator operates the operation device 26 to raise the lifting magnet 6 to a predetermined height. Hence, the object attracted to the lifting magnet 6 is lifted together with the lifting magnet 6. This operation performed by the operator also serves as a trigger for the controller 30 to start a compensation control which will be described later. Whether or not the lifting magnet 6 rose to the predetermined height may be determined based on the attitude of the attachment, a position of each connecting pint of the attachment, an elapsed time from a time when the raising of the lifting magnet 6 is started, or may be determined based on the posture of the attachment, the position of each connecting pin of the attachment, the elapsed time from the start of raising the lifting magnet 6, an operation state of an attraction switch (weak excitation button 65A, strong excitation button 65B, release button 65C), or the like.

Next, the weight calculating part 32 of the controller 30 calculates the weight (current weight) of the object attracted to (lifted by) the lifting magnet 6.

Next, in a case where the current weight is heavier than the target weight, the attraction force control part 33 of the controller 30 performs the compensation control of the current supplied to the lifting magnet 6. For example, the attraction force control part 33 performs an adjustment so as to decrease the current command value. In this case, the magnetic force (attraction force) of the lifting magnet 6 decreases, and a portion of the object attracted to the lifting magnet 6 falls. That is, the weight of the object attracted to the lifting magnet 6 decreases.

Hereinafter, during the compensation control, the controller 30 repeats the calculation of the weight (current weight) of the object attracted to the lifting magnet 6 and the adjustment (decreasing) of the current command value, until the current weight reaches the target weight. The current command value at a time when the current weight reaches the target weight will be referred to as a second current command value.

Next, the attraction force control part 33 of the controller 30 sets the current command value to a third current command value. The third current command value is a current command value larger than the second current command value. Thus, the object having the target weight is prevented from falling off from the lifting magnet 6.

Next, the controller 30 notifies the operator when the current weight reaches the target weight. A method of notification may display the notification on the display device 40, or output the notification by speech, for example.

Next, the notified operator operates the strong excitation button 65B to put the lifting magnet 6 into the attracting state (strong attracting state). Next, the operator operates the operation device 26 to move the slewing upper structure 3 and the work attachment (the boom 4 and the arm 5), and move the lifting magnet 6 above the load-carrying platform of the dump truck. Next, the operator operates the release button 65C, and the release button 65C puts the lifting magnet 6 into the released state. Thus, the object having the target weight is loaded onto the load-carrying platform of the dump truck.

The accumulated weight calculating part 35 adds the current target weight to the accumulated weight accumulated up to a previous target weight, to update the accumulated weight. The remaining weight calculating part 36 calculates the remaining weight, based on the updated accumulated weight.

By repeating the operations described above, the object having a desired accumulated weight can be loaded onto the load-carrying platform of the dump truck.

After raising the lifting magnet 6 to the predetermined height, the controller 30 may prohibit the swing of the slewing upper structure 3 or limit the swing of the slewing upper structure 3 to within a predetermined angular range, until the current weight reaches the target weight (while the calculation of the current weight and the current adjustment are repeated). In this case, it is possible to prevent scattering of the falling object to the surrounding when the current weight is adjusted to become the target weight.

Although the object is loaded onto the dump truck in the example described above, the present invention is not limited to such, and the present invention may similarly be applied to a case where the object having a desired target weight is unloaded from the dump truck.

Figure 3:
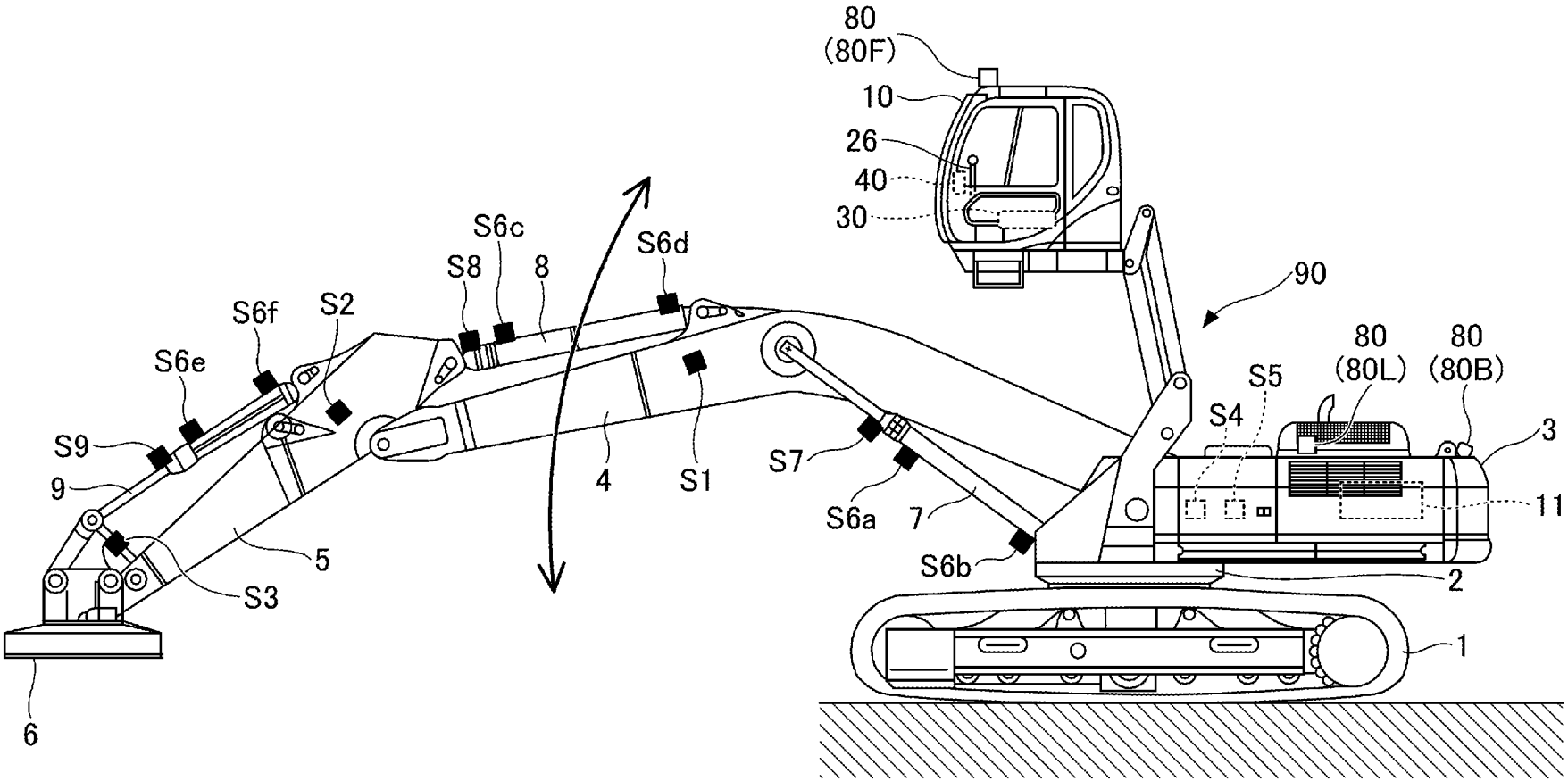
FIG. 3 is a schematic diagram illustrating a state where the work machine according to one embodiment suspends a lifting load.

Next, the vibration of the attachment will be described with reference to FIG. 3. FIG. 3 is a schematic diagram illustrating a state where the work machine 100 according to the present embodiment suspends a lifting load.

When lifting the lifting load by the lifting magnet 6, the attachment lowers the boom 4, opens the arm 5, and lifts the lifting object at an attitude in which the lifting magnet 6 is closed. In addition, the attachment is supported by the slewing upper structure 3 on the foot pin side of the boom 4. Moreover, a heavy lifting magnet 6 is provided on the tip end of the attachment. Due to this heavy lifting magnet 6, vibration is generated in the boom 4 when raising the boom. Further, due to the vibration of the boom 4, vibration is also generated in the pressure of the boom cylinder 7 (detected values of the sensors S6*a* and S6*b*). For this reason, when the weight calculating part 32 detects the weight of the lifting load based on the pressure of the boom cylinder 7, the weight calculating part 32 may not be able to suitably calculate the weight of the lifting load.

<First Exemplary Implementation>

Next, an operation for reducing the vibration of the boom 4 in the work machine 100 according to a first exemplary implementation, will be described with reference to FIG. 4 and FIG. 5. In the work machine 100 according to the first exemplary implementation, the controller 30 controls a working pressure of the boom cylinder 7 to reduce the vibration of the boom 4.

Figure 4:
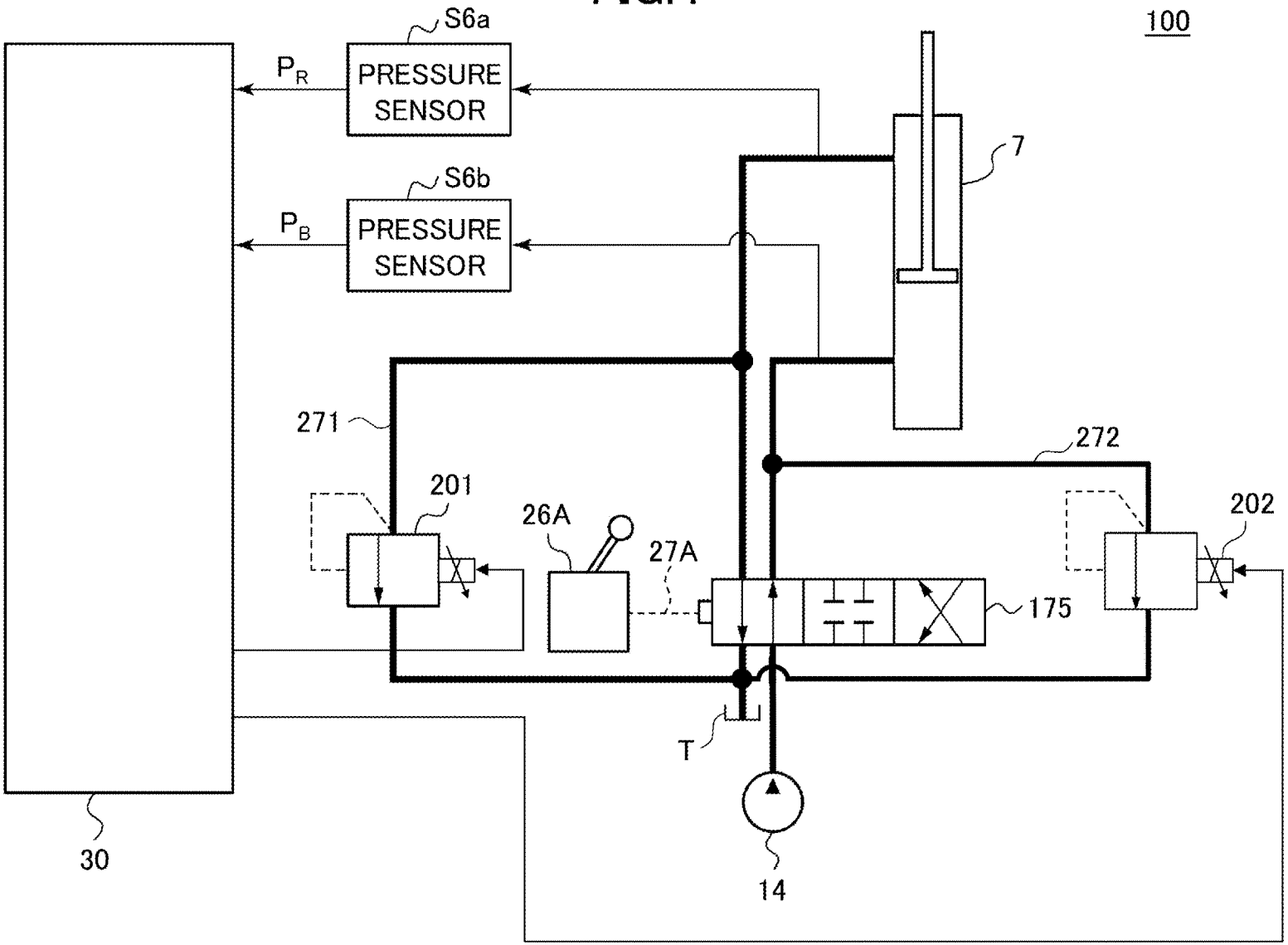
FIG. 4 is a diagram illustrating a hydraulic circuit of a boom cylinder in the work machine according to a first exemplary implementation.

FIG. 4 is a diagram illustrating a hydraulic circuit of the boom cylinder 7 in the work machine 100 according to the first exemplary implementation.

In this exemplary implementation, it is assumed that the boom 4, that is, the boom cylinder 7, is operated by a boom operating lever 26A. Further, a pilot line for transferring a secondary-side pilot pressure, from the boom operating lever 26A to a port of a boom controlling valve 175 that supplies the working fluid to the boom cylinder 7 inside the control valve 17, is referred to as a pilot line 27A.

As illustrated in FIG. 4, in this exemplary implementation, bypass fluid passages 271 and 272 which branch from between the boom controlling valve 175 in the control valve 17 and the rod-side fluid chamber, and between the boom controlling valve 175 and the bottom-side fluid chamber of the boom cylinder 7, respectively, and discharge the working fluid to a tank T, are provided.

The bypass fluid passage 271 is provided with a solenoid relief valve 201 that discharges the working fluid in the rod-side fluid chamber of the boom cylinder 7 to the tank T.

The bypass fluid passage 272 is provided with a solenoid relief valve 202 that discharges the working fluid in the bottom-side fluid chamber of the boom cylinder 7 to the tank T.

The bypass fluid passages 271 and 272 and the solenoid relief valves 201 and 202 may be provided either inside or outside the control valve 17.

A rod pressure $P_R$ of the boom cylinder 7, detected by the boom rod pressure sensor S6*a*, is input to the controller 30. A bottom pressure $P_B$ of the boom cylinder 7, detected by the boom bottom pressure sensor S6*b*, is input to the controller 30.

The controller 30 can monitor the rod pressure $P_R$ and the bottom pressure $P_B$, based on the output signals of the boom rod pressure sensor S6*a* and the boom bottom pressure sensor S6*b* input to the controller 30. In addition, the controller 30 can appropriately output current command values to the solenoid relief valves 201 and 202, to forcibly discharge the working fluid in the rod-side fluid chamber or the bottom-side fluid chamber of the boom cylinder 7 to the tank T, thereby reducing an excessive pressure inside the boom cylinder 7.

The vibration control part 37 of the controller 30 detects the generation of the vibration, based on changes in the rod pressure $P_R$ and the bottom pressure $P_B$ of the boom cylinder 7 detected by the boom rod pressure sensor S6*a* and the boom bottom pressure sensor S6*b*. Thereafter, the solenoid relief valves 201 and 202 are controlled, that is, the hydraulic pressure of the boom cylinder 7 is controlled, using the detected values of the boom rod pressure sensor S6*a* and the boom bottom pressure sensor S6*b*. More particularly, the vibration control part 37 of the controller 30 controls the solenoid relief valves 201 and 202, so as to reduce a sudden pressure change in the boom cylinder 7. Hence, the vibration of the boom 4 (refer to FIG. 3) can be reduced. In addition, the weight calculating part 32 can suitably calculate the weight of the lifting load, based on the pressure of the boom cylinder 7 (detected values of the sensors S6*a* and S6*b*). The generation of the vibration may be detected, using an acceleration sensor (such as a body inclination sensor S4 or the like).

The controller 30 may control the solenoid relief valves 201 and 202, based on the angular velocity of the boom 4 detected by the boom angle sensor S1. Thus, the vibration of the boom 4 can be reduced.

In addition, by reducing the vibration of the boom 4, the weight calculating part 32 can suitably calculate the weight of the lifting load, based on the pressure of the boom cylinder 7 (detected values of the sensors S6*a* and S6*b*). The angular velocity of the boom 4 may also be detected by the boom cylinder stroke sensor S7.

Figure 5:
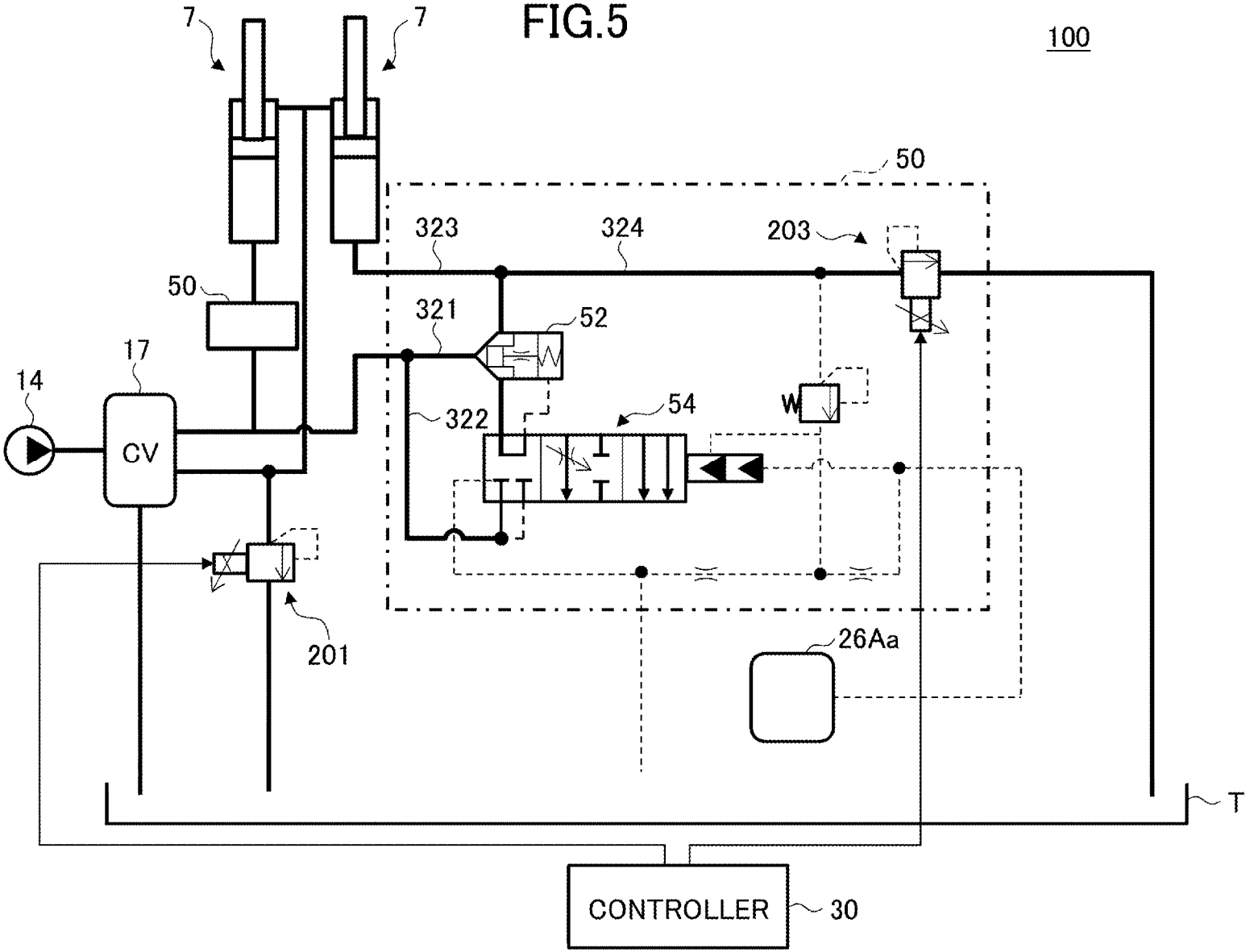
FIG. 5 is a diagram for explaining the hydraulic circuit of another boom cylinder in the work machine according to the first exemplary implementation.

FIG. 5 is a diagram for explaining a hydraulic circuit of another boom cylinder 7 in the work machine 100 according to the first exemplary implementation. Hereinafter, although two boom cylinders 7 are illustrated in FIG. 5, the hydraulic circuit for one boom cylinder 7 (the boom cylinder 7 on the right side in FIG. 5) will mainly be described, because the control valve 17 and a pressure holding circuit 50 which will be described later, are interposed between the main pump 14 and the boom cylinder 7 in a similar manner for each of the two boom cylinders 7.

The solenoid relief valve 201 for discharging the working fluid in the rod-side fluid chamber of the boom cylinder 7 to the tank T is provided in a fluid passage that branches from between the control valve 17 and the rod-side fluid chamber.

As illustrated in FIG. 5, the work machine 100 according to the present exemplary implementation is provided with a pressure holding circuit 50 that holds the working fluid in the bottom-side fluid chamber of the boom cylinder 7 so as not to be discharged therefrom, even in a case where the hydraulic hose breaks due to a rupture or the like, for example.

The pressure holding circuit 50 is interposed in a fluid passage connecting the control valve 17 and the bottom-side fluid chamber of the boom cylinder 7. The pressure holding circuit 50 mainly includes a holding valve 52 and a spool valve 54.

The holding valve 52 supplies the working fluid supplied from the control valve 17 to the bottom-side fluid chamber of the boom cylinder 7 via a fluid passage 321, regardless of a state of the spool valve 54.

Moreover, in a case where the spool valve 54 is in a non-communicating state (spool state at the left end in FIG. 5), the holding valve 52 holds the working fluid in the bottom-side fluid chamber of the boom cylinder 7, so that the working fluid is not discharged to a downstream side of the pressure holding circuit 50. On the other hand, in a case where the spool valve 54 is in a communicating state (spool state at the right end in FIG. 5), the holding valve 52 can discharge the working fluid in the bottom-side fluid chamber of the boom cylinder 7 to the downstream side of the pressure holding circuit 50 via a fluid passage 322.

The communicating and non-communicating states of the spool valve 54 are controlled according to the pilot pressure input to a port from a boom lowering remote control valve 26Aa, included in the operation device 26 for operating the boom cylinder 7, and outputting the pilot pressure corresponding to the lowering operation of the boom 4 (boom lowering operation). More particularly, in a case where the pilot pressure indicating that the boom lowering operation is being performed is input from the boom lowering remote control valve 26Aa, the spool valve 54 is controlled to the spool state corresponding to the communicating state (the spool state at the right end in FIG. 5). On the other hand, in a case where the pilot pressure indicating that the boom lowering operation is not being performed is input from the boom lowering remote control valve 26Aa, the spool valve 54 is controlled to the spool state corresponding to the non-communicating state (the spool state at the left end in FIG. 5). Thus, even if the break or the like is generated in the hydraulic hose on the downstream side of the pressure holding circuit 50 in a state where the boom lowering operation is not being performed, the working fluid (bottom pressure) in the bottom-side fluid chamber of the boom cylinder 7 is held, thereby making it possible to prevent the boom 4 from falling.

The pressure holding circuit 50 also includes a solenoid relief valve 203.

The solenoid relief valve 203 is provided in a fluid passage 324, that branches from a fluid passage 323 between the holding valve 52 in the pressure holding circuit 50 and the bottom-side fluid chamber of the boom cylinder 7, and is connected to the tank T. In other words, the solenoid relief valve 203 discharges the working fluid to the tank T from the fluid passage 323 on the upstream side of the holding valve, that is, on the side close to the boom cylinder 7. Accordingly, the solenoid relief valve 203 can discharge the working fluid in the bottom-side fluid chamber of the boom cylinder 7 to the tank T, regardless of the operation state of the pressure holding circuit 50, specifically, regardless of whether the spool valve 54 is in the communicating state or the non-communicating state. That is, the working fluid in the bottom-side fluid chamber of the boom cylinder 7 can be discharged to the tank T regardless of the presence or absence of the boom lowering operation, while preventing the boom 4 from falling by the function of the pressure holding circuit 50 to hold the working fluid in the bottom-side fluid chamber of the boom cylinder 7, thereby making it possible to reduce an excessive bottom pressure.

The controller 30 can monitor the rod pressure PR and the bottom pressure PB, based on the output signals of the boom rod pressure sensor S6*a* and the boom bottom pressure sensor S6*b* input to the controller 30. In addition, the controller 30 can forcibly discharge the working fluid in the rod-side fluid chamber or the bottom-side fluid chamber of the boom cylinder 7 to the tank T, regardless of the presence or absence of the boom lowering operation, by outputting the current command values to the solenoid relief valve 201 and 203 as appropriate, thereby making it possible to reduce the excessive pressure in the boom cylinder 7.

The vibration control part 37 of the controller 30 controls the solenoid relief valves 201 and 203, based on the rod pressure PR and the bottom pressure PB of the boom cylinder 7 detected by the boom rod pressure sensor S6*a* and the boom bottom pressure sensor S6*b*, respectively. In other words, the vibration control part 37 controls the hydraulic pressure of the boom cylinder 7. More particularly, the vibration control part 37 of the controller 30 controls the solenoid relief valves 201 and 203, so as to reduce a sudden pressure change in the boom cylinder 7. Hence, it is possible to reduce the vibration of the boom 4 (refer to FIG. 3). In addition, the weight calculating part 32 can suitably calculate the weight of the lifting load, based on the pressure of the boom cylinder 7 (detected values of the sensors S6*a* and S6*b*).

Moreover, the vibration control part 37 of the controller 30 may determine the generation of the vibration of the attachment (boom 4). The vibration control part 37 may determine that the vibration is generated in the attachment (boom 4) when a ripple in the pressure value of the boom cylinder 7 is detected within a predetermined time period, for example. Furthermore, the vibration control part 37 may determine that the vibration is generated in the attachment (boom 4) when the pressure value of the boom cylinder 7 rapidly increases or decreases within a predetermined time period and an amount of increase or decrease in the pressure value exceeds a predetermined value, for example. The vibration control part 37 of the controller 30 may determine the generation of the vibration in the manner described above.

The controller 30 may control the solenoid relief valves 201 and 203, based on the angular velocity of the boom 4 detected by the boom angle sensor S1. Thus, it is possible to reduce the vibration of the boom 4. In addition, the weight calculating part 32 can suitably calculate the weight of the lifting load, based on the pressure of the boom cylinder 7 (detected values of the sensors S6*a* and S6*b*). The angular velocity of the boom 4 may also be detected by the boom cylinder stroke sensor S7.

The controller 30 may control only the solenoid relief valve 203 on the bottom side, or may control both the solenoid relief valve 203 on the bottom side and the solenoid relief valve 201 on the rod side.

<Second Exemplary Implementation>

Next, an operation for reducing the vibration of the boom 4 in the work machine 100 according to a second exemplary implementation, will be described with reference to FIG. 6 through FIG. 8. In the work machine 100 according to the second exemplary implementation, the controller 30 controls the control valve 17 (controlling valve 175) to reduce the vibration of the boom 4.

Figure 6:
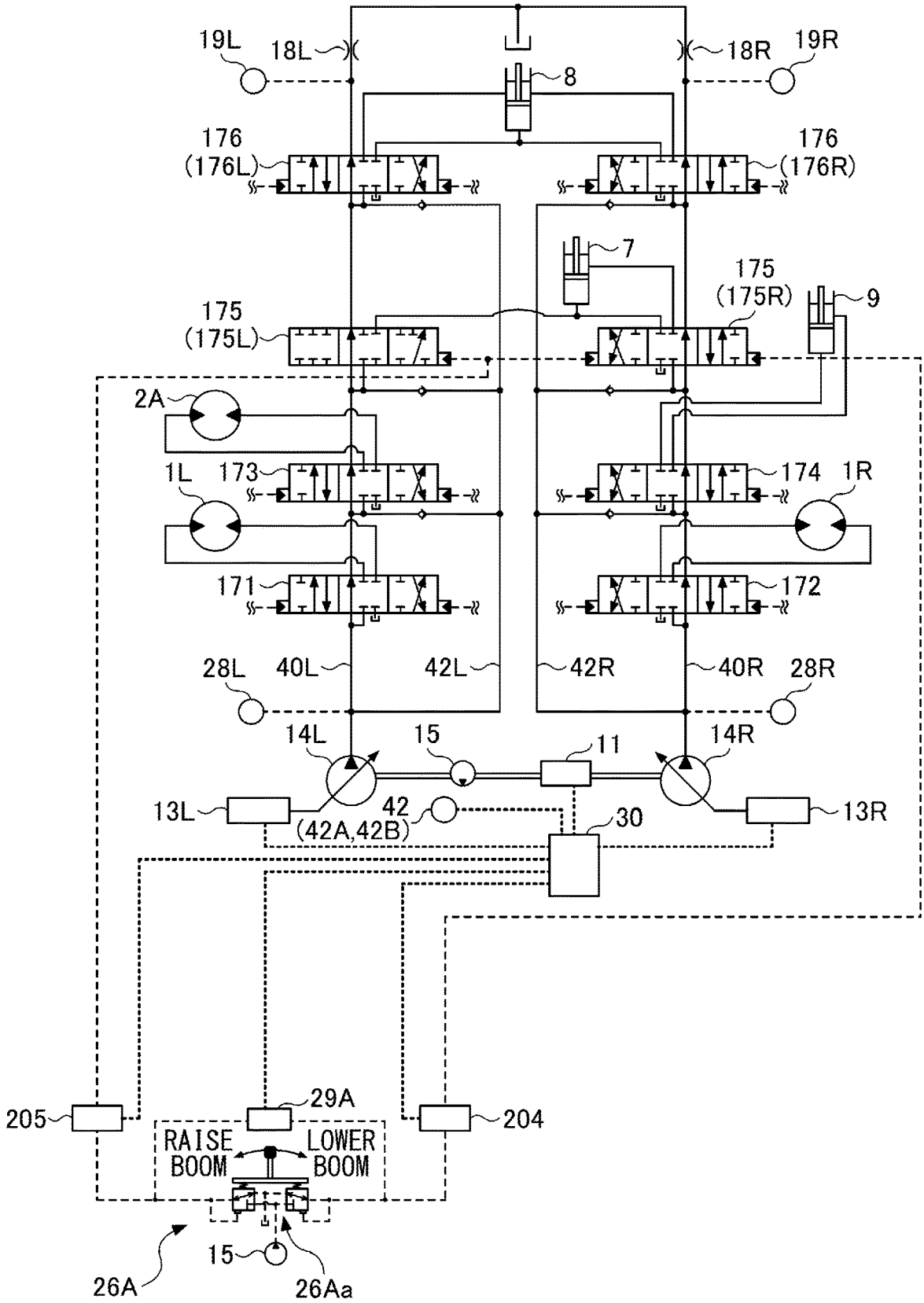
FIG. 6 is a diagram for explaining the hydraulic circuit of the boom cylinder in the work machine according to a second exemplary implementation.

FIG. 6 is a diagram for explaining the hydraulic circuit of the boom cylinder 7 in the work machine 100 according to the second exemplary implementation. In this exemplary implementation, the operating lever of the work machine is a hydraulic operating lever, and the controller 30 reduces the vibration of the boom 4 by controlling the pilot pressure to the control valve 17 (controlling valve 175). In FIG. 6, a mechanical power transmission line, the working fluid line, the pilot line, and an electric control line are indicated by a double line, a solid line, a broken line, and a dotted line, respectively.

The hydraulic system circulates the working fluid from a left main pump 14L driven by the engine 11 to the working fluid tank via a left center bypass pipeline 40L or a left parallel pipeline 42L, and circulates the working fluid from a right main pump 14R driven by the engine 11 to the working fluid tank via a right center bypass pipeline 40R or a right parallel pipeline 42R. The left main pump 14L and the right main pump 14R correspond to the main pump 14 of FIG. 2.

The left center bypass pipeline 40L is a working fluid line passing through controlling valves 171, 173, 175L, and 176L disposed in the control valve 17. The right center bypass pipeline 40R is a working fluid line passing through controlling valves 172, 174, 175R, and 176R disposed in the control valve 17. The controlling valves 175L and 175R correspond to the controlling valve 175 of FIG. 2. The controlling valves 176L and 176R correspond to the controlling valve 176 of FIG. 2.

The controlling valve 171 is a spool valve that switches the flow of the working fluid, in order to supply the working fluid discharged from the left main pump 14L to the left drive hydraulic motor 1L, and discharge the working fluid discharged from the left drive hydraulic motor 1L to the working fluid tank.

The controlling valve 172 is a spool valve that switches the flow of the working fluid, in order to supply the working fluid discharged from the right main pump 14R to the right drive hydraulic motor 1R, and discharge the working fluid discharged from the right drive hydraulic motor 1R to the working fluid tank.

The controlling valve 173 is a spool valve that switches the flow of the working fluid, in order to supply the working fluid discharged from the left main pump 14L to the swing hydraulic motor 2A, and discharge the working fluid discharged from the swing hydraulic motor 2A to the working fluid tank.

The controlling valve 174 is a spool valve that switches the flow of the working fluid, in order to supply the working fluid discharged from the right main pump 14R to the lifting magnet cylinder 9, and discharge the working fluid in the lifting magnet cylinder 9 to the working fluid tank.

The controlling valve 175L is a spool valve that switches the flow of the working fluid, in order to supply the working fluid discharged from the left main pump 14L to the boom cylinder 7.

The controlling valve 175R is a spool valve that switches the flow of the working fluid, in order to supply the working fluid discharged from the right main pump 14R to the boom cylinder 7, and discharge the working fluid in the boom cylinder 7 to the working fluid tank.

The controlling valve 176L is a spool valve that switches the flow of the working fluid, in order to supply the working fluid discharged from the left main pump 14L to the arm cylinder 8, and discharge the working fluid in the arm cylinder 8 to the working fluid tank.

The controlling valve 176R is a spool valve that switches the flow of the working fluid, in order to supply the working fluid discharged from the right main pump 14R to the arm cylinder 8, and discharge the working fluid in the arm cylinder 8 to the working fluid tank.

The left parallel pipeline 42L is a working fluid line parallel to the left center bypass pipeline 40L. In a case where the flow of the working fluid passing through the left center bypass pipeline 40L is restricted or cut off by one of the controlling valves 171, 173, and 175L, the left parallel pipeline 42L can supply the working fluid to a control valve that is located further downstream. The right parallel pipeline 42R is a working fluid line parallel to the right center bypass pipeline 40R. In a case where the flow of the working fluid passing through the right center bypass pipeline 40R is restricted or cut off by one of the controlling valves 172, 174, and 175R, the right parallel pipeline 42R can supply the working fluid to a control value that is located further downstream.

A left regulator 13L is configured to be able to control the discharge amount of the left main pump 14L. In the present embodiment, the left regulator 13L controls the discharge amount of the left main pump 14L by adjusting the swash plate tilt angle of the left main pump 14L according to the discharge pressure of the left main pump 14L, for example. A right regulator 13R is configured to be able to control the discharge amount of the right main pump 14R. In the present embodiment, the right regulator 13R controls the discharge amount of the right main pump 14R by adjusting the swash plate tilt angle of the right main pump 14R according to the discharge pressure of the right main pump 14R, for example. The left regulator 13L and the right regulator 13R correspond to the regulator 13 of FIG. 2. The left regulator 13L reduces the discharge amount by adjusting the swash plate tilt angle of the left main pump 14L according to an increase in the discharge pressure of the left main pump 14L, for example. The same applies to the right regulator 13R. This is to prevent an absorption horsepower of the main pump 14 represented by a product of the discharge pressure and the discharge amount from exceeding an output horsepower of the engine 11.

A left discharge pressure sensor 28L is an example of the discharge pressure sensor 28, and detects the discharge pressure of the left main pump 14L, and outputs the detected value of the discharge pressure to the controller 30. The same applies to the right discharge pressure sensor 28R.

A negative control employed in the hydraulic system of FIG. 6 will now be described.

In the left center bypass pipeline 40L, a left throttle 18L is disposed between the controlling valve 176L located on a most downstream side and the working fluid tank. The flow of the working fluid discharged from the left main pump 14L is restricted by the left throttle 18L. The left throttle 18L generates a control pressure for controlling the left regulator 13L. A left control pressure sensor 19L is a sensor for detecting the control pressure, and outputs the detected value to the controller 30. In the right center bypass pipeline 40R, a right throttle 18R is disposed between the controlling valve 176R located on a most downstream side and the working fluid tank. The flow of the working fluid discharged from the right main pump 14R is restricted by the right throttle 18R. The right throttle 18R generates a control pressure for controlling the right regulator 13R. A right control pressure sensor 19R is a sensor for detecting the control pressure, and outputs the detected value to the controller 30.

The controller 30 controls the discharge amount of the left main pump 14L, by adjusting the swash plate tilt angle of the left main pump 14L according to the control pressure. The controller 30 decreases the discharge amount of the left main pump 14L as the control pressure becomes higher, and increases the discharge amount of the left main pump 14L as the control pressure becomes lower. The discharge amount of the right main pump 14R is controlled in a similar manner.

More particularly, as illustrated in FIG. 6, in a standby state where none of the hydraulic actuators in the work machine 100 is operated, the working fluid discharged from the left main pump 14L passes through the left center bypass pipeline 40L and reaches the left throttle 18L. The flow of the working fluid discharged from the left main pump 14L increases the control pressure generated on the upstream side of the left throttle 18L. As a result, the controller 30 reduces the discharge amount of the left main pump 14L to a tolerable minimum discharge amount, and reduces a pressure loess (pumping loss) as the discharged working fluid passes through the left center bypass pipeline 40L. On the other hand, in a case where one of the hydraulic actuators is operated, the working fluid discharged from the left main pump 14L flows into the hydraulic actuator that is an operation target via the control valve corresponding to the hydraulic actuator that is the operation target. Then, the flow of the working fluid discharged from the left main pump 14L reduces or eliminates the amount of the working fluid reaching the left throttle 18L, thereby reducing the control pressure generated on the upstream side of the left throttle 18L. As a result, the controller 30 increases the discharge amount of the left main pump 14L, to circulate a sufficient amount of the working fluid to the hydraulic actuator that is the operation target, thereby positively driving the hydraulic actuator that is the operation target. The same applies to the working fluid discharged from the right main pump 14R.

According to the configuration described above, the hydraulic system of FIG. 6 can reduce wasteful energy consumption in the standby state at each of the left main pump 14L and the right main pump 14R. The wasteful energy consumption includes the pumping loss generated in the left center bypass pipeline 40L by the working fluid discharged from the left main pump 14L, and the pumping loss generated in the right center bypass pipeline 40R by the working fluid discharged from the right main pump 14R. In addition, in the case where the hydraulic actuator is operated, the hydraulic system of FIG. 6 can supply a necessary and sufficient amount of the working fluid from each of the left main pump 14L and the right main pump 14R to the hydraulic actuator that is the operation target.

A pilot pressure circuit, connecting the remote control valve 26Aa to the controlling valve 175 (175L and 175R), is provided with pressure reducing valves 204 and 205.

The work machine 100 causes the lifting magnet 6 to attract the lifting load (transporting object) by applying a current to the lifting magnet 6 based on the operation command, and thereafter performs a boom raising operation. Then, a swing operation and an arm opening operation are performed in order to transport the lifting load to a release position. However, if the vibration of the attachment (boom 4) generated during the attraction or the boom raising operation is large, the vibration continues even during the swing operation, and the weight of the lifting load cannot be measured accurately. For this reason, the vibration control part 37 of the controller 30 controls the pressure reducing valves 204 and 205, 205, based on the rod pressure $P_R$ and the bottom pressure $P_B$ of the boom cylinder 7 detected by the boom rod pressure sensor S6*a* and the boom bottom pressure sensor S6*b*. That is, the pilot pressure of the control valve 17 (controlling valve 175) is controlled. More particularly, the vibration control part 37 of the controller 30 controls the pressure reducing valves 204 and 205, so as to reduce a sudden pressure change in the boom cylinder 7. Hence, it is possible to reduce the vibration of the boom 4 (refer to FIG. 3) within a time period from the attraction (gripping by a grapple) to the release. Further, the weight calculating part 32 calculates the weight that is calculated in a case where the vibration of the boom 4 is less than or equal to the predetermined threshold value, as the weight of the current lifting load. Accordingly, the weight calculating part 32 can suitably calculate the weight of the lifting load, based on the pressure of the boom cylinder 7 (detected values of the sensors S6*a* and S6*b*).

The controller 30 may control the pressure reducing valves 204 and 205, based on the angular velocity of the boom 4 detected by the boom angle sensor S1. In this case, it is possible to reduce the vibration of the boom 4. In addition, the weight calculating part 32 can suitably calculate the weight of the lifting load, based on the pressure of the boom cylinder 7 (detected values of the sensors S6*a* and S6*b*). The angular velocity of the boom 4 may also be detected by the boom cylinder stroke sensor S7.

Figure 7:
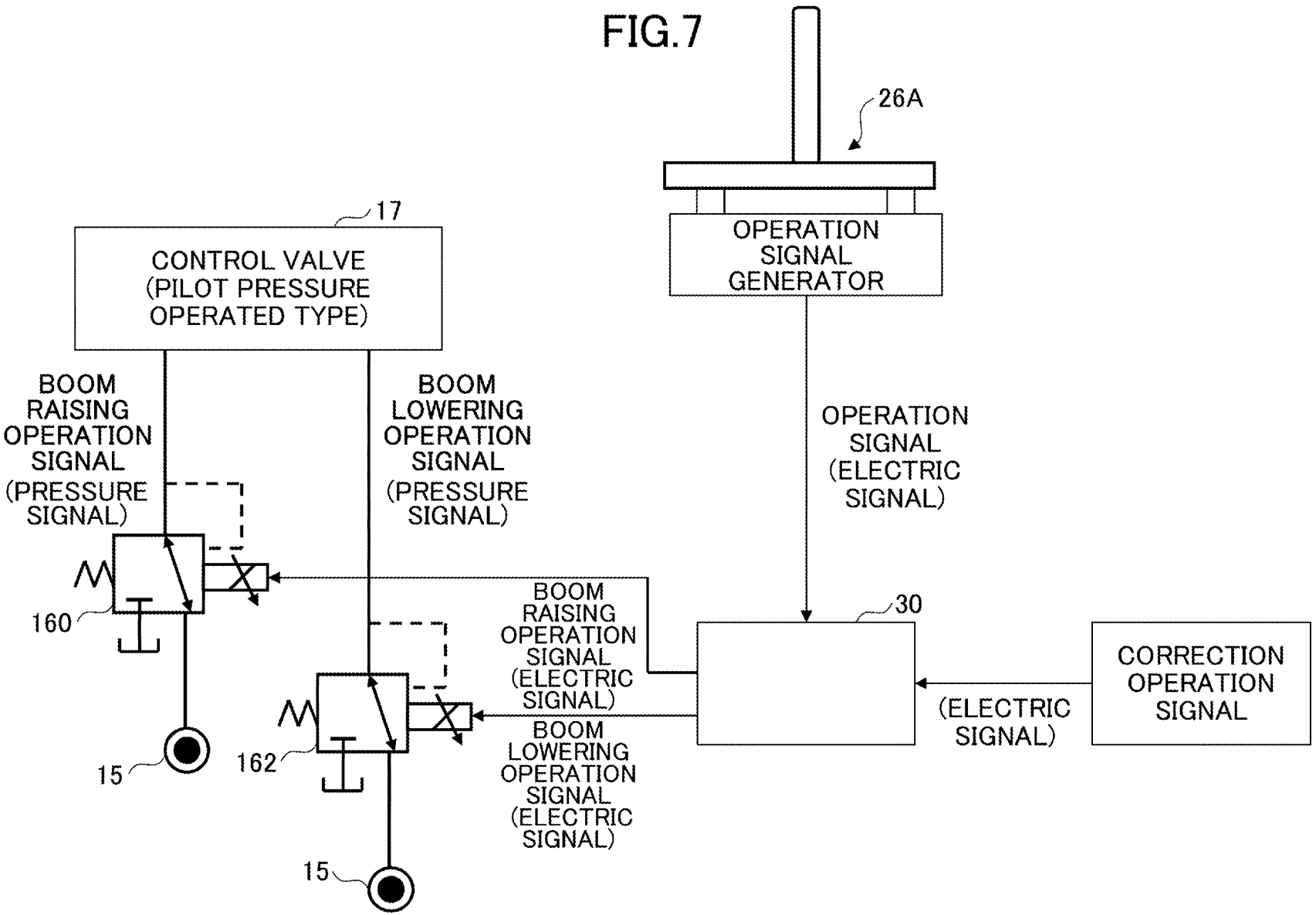
FIG. 7 is a diagram illustrating a configuration example of an electric operation system in the work machine according to the second exemplary implementation.

FIG. 7 is a diagram illustrating a configuration example of an electric operation system in the work machine 100 according to the second exemplary implementation. In this example, the operating lever of the work machine is a solenoid operating lever, and the controller 30 reduces the vibration of the boom 4, by controlling the pilot pressure to the control valve 17 (controlling valve 175).

In a case where the electric operation system provided with the electric operating lever is employed, the controller 30 can easily execute an autonomous control function, compared to a case where a hydraulic operation system including a hydraulic operating lever is employed. More particularly, the electric operating system illustrated in FIG. 7 is an example of a boom operating system, and is configured to mainly include a pilot pressure-operated control valve 17, the boom operating lever 26A as the electric operating lever, the controller 30, a solenoid valve 160 for boom raising operation, and a solenoid valve 162 for boom lowering operation. The electric operating system of FIG. 7 can also be similarly applied to an arm operating system, a bucket operating system, or the like.

The pilot pressure-operated control valve 17 includes the controlling valve 175 (refer to FIG. 6) related to the boom cylinder 7, the controlling valve 176 (refer to FIG. 6) related to the arm cylinder 8, the controlling valve 174 (refer to FIG. 6) related to the lifting magnet cylinder 9, or the like. The solenoid valve 160 is configured to be able to adjust a flow path area of a pipeline connecting the pilot pump 15 and a raising side pilot port of the controlling valve 175. The solenoid valve 162 is configured to be able to adjust a flow path area of a pipeline connecting the pilot pump 15 and a lowering side pilot port of the controlling valve 175.

In a case where a manual operation is performed, the controller 30 generates a boom raising operation signal (electric signal) or a boom lowering operation signal (electric signal) according to an operation signal (electric signal) output from an operation signal generating part of the boom operating lever 26A. The operation signal output by the operation signal generating part of the boom operating lever 26A is an electric signal that varies according to an operation amount and an operation direction of the boom operating lever 26A.

More particularly, in a case where the boom operating lever 26A is operated in the boom raising direction, the controller 30 outputs a boom raising operation signal (electric signal) corresponding to a lever operation amount to the solenoid valve 160. The solenoid valve 160 adjusts the flow path area according to the boom raising operation signal (electric signal), and controls the pilot pressure acting on the raising side pilot port of the controlling valve 175, as the boom raising operation signal (pressure signal). Similarly, in a case where the boom operating lever 26A is operated in the boom lowering direction, the controller 30 outputs a boom lowering operation signal (electric signal) corresponding to the lever operation amount to the solenoid valve 162. The solenoid valve 162 adjusts the flow path area according to the boom lowering operation signal (electric signal), and controls the pilot pressure acting on the lowering side pilot port of the controlling valve 175, as the boom lowering operation signal (pressure signal).

In a case where an autonomous control is executed, the controller 30 generates the boom raising operation signal (electric signal) or the boom lowering operation signal (electric signal) according to a correction operation signal (electric signal), in place of the operation signal (electric signal) output by the operation signal generating part of the boom operating lever 26A, for example. The correction operation signal may be an electric signal generated by the controller 30, or may be an electric signal generated by an external controller or the like other than the controller 30.

The vibration control part 37 of the controller 30 controls the solenoid valves 160 and 162, based on the rod pressure PR and the bottom pressure PB of the boom cylinder 7 detected by the boom rod pressure sensor S6*a* and the boom bottom pressure sensor S6*b*. That is, the pilot pressure of the control valve 17 (controlling valve 175) is controlled. More particularly, the vibration control part 37 of the controller 30 controls the solenoid valves 160 and 162, so as to reduce a sudden pressure change of the boom cylinder 7. Thus, it is possible to reduce the vibration of the boom 4 (refer to FIG. 3). In addition, the weight calculating part 32 can suitably calculate the weight of the lifting load, based on the pressure of the boom cylinder 7 (detected values of the sensors S6*a* and S6*b*).

The controller 30 may control the solenoid valves 160 and 162, based on the angular velocity of the boom 4 detected by the boom angle sensor S1. In this case, it is possible to reduce the vibration of the boom 4. In addition, the weight calculating part 32 can suitably calculate the weight of the lifting load, based on the pressure of the boom cylinder 7 (detected values of the sensors S6*a* and S6*b*). The angular velocity of the boom 4 may also be detected by the boom cylinder stroke sensor S7.

Figure 8:
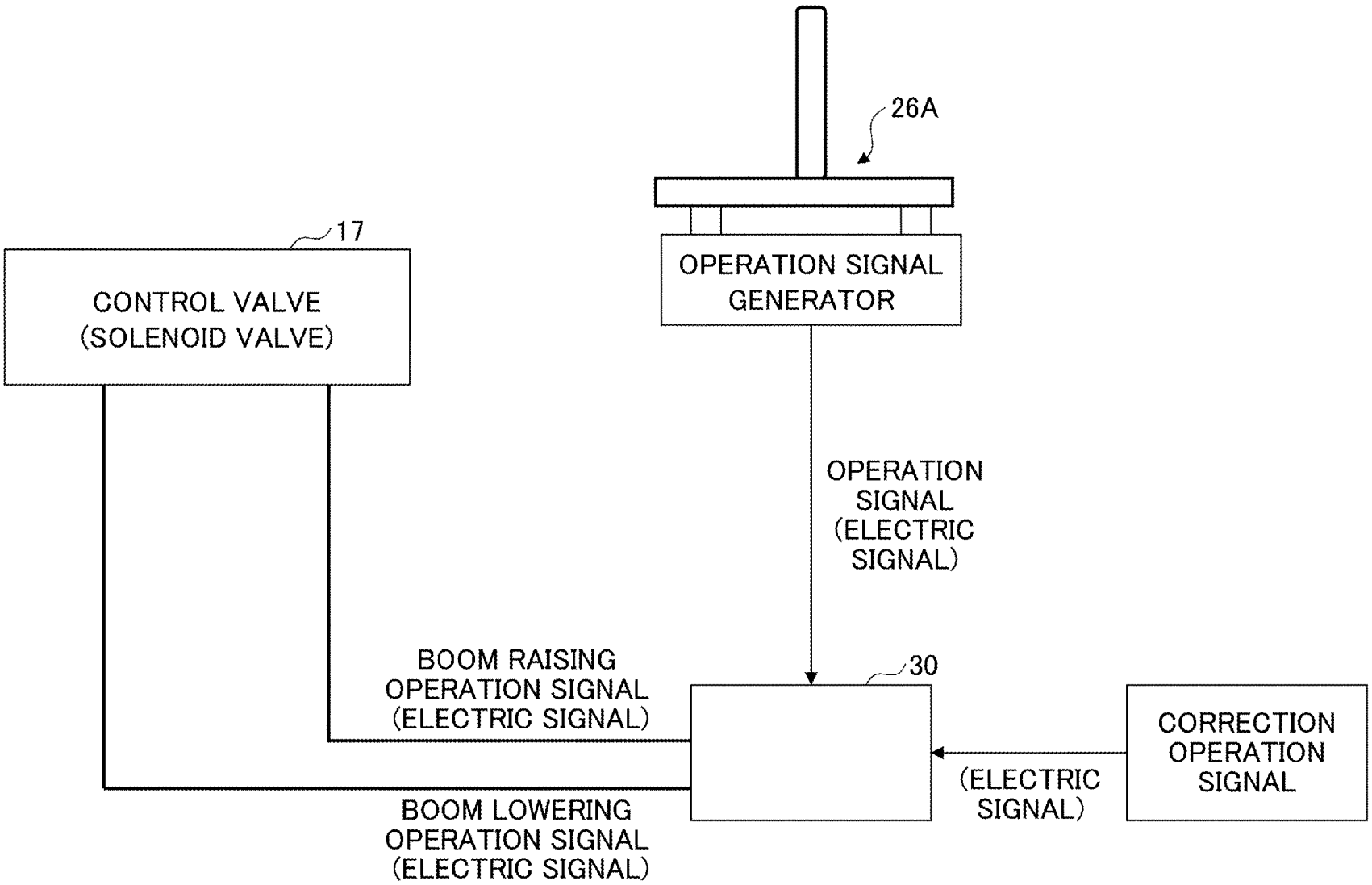
FIG. 8 is a diagram illustrating a configuration example of another electric operation system in the work machine according to the second exemplary implementation.

FIG. 8 is a diagram illustrating a configuration example of another electric operation system in the work machine 100 according to the second exemplary implementation. In this example, the operating lever of the work machine is a solenoid operating lever, the control valve 17 (controlling valve 175) is a solenoid valve, and the controller 30 reduces the vibration of the boom 4 by controlling an electric signal to the control valve 17 (controlling valve 175).

The control valve 17 is a solenoid valve, and is controlled by an operation signal (electric signal) from the controller 30.

In this case, the vibration control part 37 of the controller 30 directly controls the control valve 17, based on the rod pressure PR and the bottom pressure PB of the boom cylinder 7 detected by the boom rod pressure sensor S6*a* and the boom bottom pressure sensor S6*b*. More particularly, the vibration control part 37 of the controller 30 controls the control valve 17, so as to reduce a sudden pressure change in the boom cylinder 7. Thus, it is possible to reduce the vibration of the boom 4 (refer to FIG. 3). In addition, the weight calculating part 32 can suitably calculate the weight of the lifting load, based on the pressure of the boom cylinder 7 (detected values of the sensors S6*a* and S6*b*).

The controller 30 may directly control the control valve 17, based on the angular velocity of the boom 4 detected by the boom angle sensor S1. In this case, it is possible to reduce the vibration of the boom 4. In addition, the weight calculating part 32 can suitably calculate the weight of the lifting load, based on the pressure of the boom cylinder 7 (detected values of the sensors S6*a* and S6*b*). The angular velocity of the boom 4 may also be detected by the boom cylinder stroke sensor S7.

<Third Exemplary Implementation>

Next, an operation of reducing the vibration of the boom 4 in the work machine 100 according to a third exemplary implementation will be described, with reference to FIG. 9.

Figure 9:
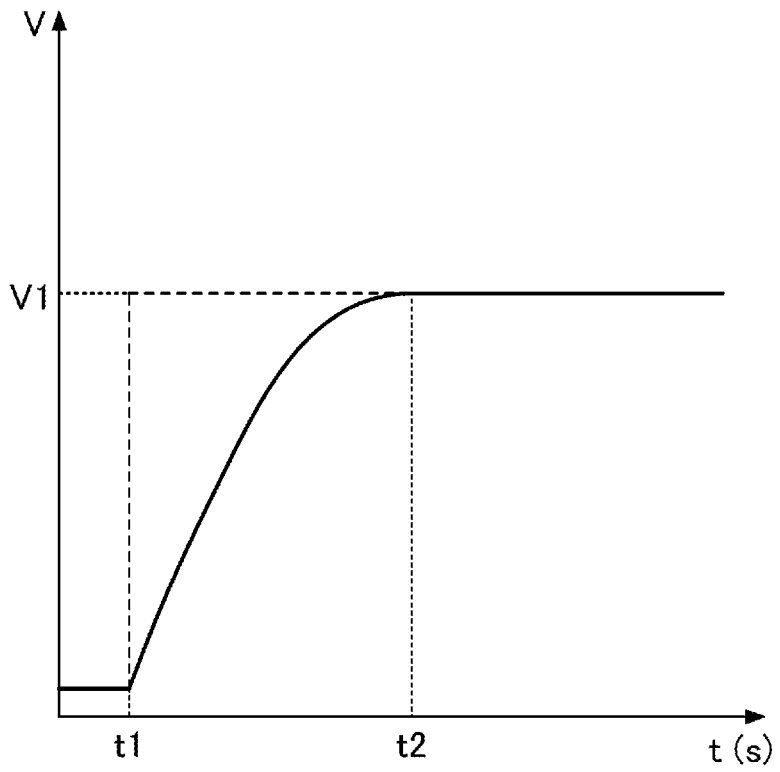
FIG. 9 is a diagram for explaining switching of a supply voltage of a lifting magnet in the work machine according to a third exemplary implementation.

FIG. 9 is a diagram for explaining switching of a supply voltage (attraction force, magnetic force) of the lifting magnet 6 in the work machine 100 according to the third exemplary implementation. In FIG. 9, the abscissa represents an elapsed time, and the ordinate represents a voltage supplied to the lifting magnet 6. Further, the supply voltage according to a reference example is indicated by a broken line, and the supply voltage in the present exemplary implementation is indicated by a solid line.

As illustrated in FIG. 9, the supply voltage in the reference example rises stepwise. For this reason, the boom 4 may vibrate when the transporting object, such as scrap iron or the like, attracted by the magnetic force, collides with the lifting magnet 6.

In contrast, the supply voltage in the present exemplary implementation rises smoothly. For this reason, it is possible to reduce the vibration of the boom 4 that occurs when the transporting object, such as scrap iron or the like, attracted by the magnetic force, collides with the lifting magnet 6.

The controller 30 may detect a change in the boom cylinder pressure and a change in the angular velocity (each acceleration) of the boom 4, to control the supply voltage to the lifting magnet 6.

The vibration reduction of the boom 4 by controlling the supply voltage to the lifting magnet 6 according to the third exemplary implementation may be applied to the work machine 100 according to the first and second exemplary implementations.

The embodiment described above reduces the vibration of the attachment (boom 4) by discharging the working fluid of the boom cylinder 7 to the working fluid tank T, as illustrated in FIG. 4, FIG. 5, or the like, but the present invention is not necessarily limited to this embodiment.

For example, the vibration of the attachment (boom 4) generated during the boom operation may be reduced, by supplying the working fluid of the boom cylinder 7 to the arm cylinder 8.

A switching valve (not illustrated) may be provided between the boom cylinder 7 and the arm cylinder 8, and the vibration control part 37 of the controller 30 may control the switching valve, based on the rod pressure PR and the bottom pressure PB of the boom cylinder 7 detected by the boom rod pressure sensor S6*a* and the boom bottom pressure sensor S6*b*. That is, when a combined operation corresponding to the raising operation of the boom 4 (boom raising operation) and an opening operation of the arm 5 (arm opening operation) or a closing operation of the arm 5 (arm closing operation) is performed, the switching valve switches from a cutoff state to a communicating state. More particularly, the switching valve is switched from the cutoff state to the communicating state according to a pilot pressure supplied from a solenoid proportional valve controlled by the controller 30. Thus, the hydraulic controlling valve 172 can supply the working fluid discharged from the bottom-side fluid chamber of the boom cylinder 7 to the arm cylinder 8 via the switching valve.

In addition, a restoration circuit may be formed in the controlling valve 175 of the boom cylinder 7, to discharge the working fluid of the boom cylinder 7 to the working fluid tank T. In this case, there is no need to provide the switching valve between the boom cylinder 7 and the arm cylinder 8.

Moreover, the configuration is not limited to a configuration that supplies the working fluid of the boom cylinder 7 to the arm cylinder 8. The working fluid of the boom cylinder 7 may be supplied to the swing hydraulic motor 2A, or may be supplied to a hydraulic cylinder (lifting magnet cylinder 9, bucket cylinder, or the like) that drives an end attachment.

Accordingly, the vibration can be reduced by supplying the working fluid to another hydraulic actuator that performs a combined operation with the boom 4.

According to the embodiments exemplary implementations described above, it is possible to provide a work machine that can accurately calculate the weight of the transporting object.

Although the embodiments are numbered with, for example, "first," "second," or "third," the ordinal numbers do not imply priorities of the exemplary implementations. Many other variations and modifications will be apparent to those skilled in the art.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A work machine comprising:
a lower structure;
a slewing upper structure slewably attached to the lower structure;
an attachment, including at least a boom, and attached to the slewing upper structure;
a boom cylinder configured to drive the boom;
a lifting magnet attached to the attachment;
a power controller configured to control a supply voltage that is supplied to the lifting magnet to excite the lifting magnet; and
a controller,
wherein the controller includes:
a storage device configured to store a program, and
a processor configured to execute the program to perform a process including:
calculating a weight of a transporting object to be transported by the lifting magnet, based on a boom cylinder pressure of the boom cylinder, and
generating a command for reducing vibration of the attachment,
wherein the generating generates a command to the power controller for controlling the supply voltage supplied to the lifting magnet.

2. The work machine as claimed in claim 1, wherein the calculating calculates the weight of the transporting object when the vibration of the attachment is less than or equal to a predetermined threshold value.

3. The work machine as claimed in claim 1, wherein the generating generates a command with respect to a solenoid relief valve provided in a hydraulic circuit configured to supply a working fluid to the boom cylinder.

4. The work machine as claimed in claim 1, wherein the generating generates a command with respect to a control valve configured to control a working fluid to be supplied by the boom cylinder.

5. The work machine as claimed in claim 4, wherein:
the control valve is a controlling valve operated by a pilot pressure, and
the generating generates a command with respect to a solenoid valve provided in a pilot line that inputs the pilot pressure to the control valve.

6. The work machine as claimed in claim 4, wherein:
the control valve is a solenoid controlling valve, and
the generating generates a command with respect to the control valve.

7. The work machine as claimed in claim 1, wherein the generating supplies a working fluid from the boom cylinder to another hydraulic actuator that forms a combined operation with the boom.

8. The work machine as claimed in claim 1, wherein the generating generates the command to the power controller for controlling the supply voltage which rises smoothly with respect to the lifting magnet.

9. The work machine as claimed in claim 1, wherein the process further includes:
detecting a change in the boom cylinder pressure or a change in an angular velocity or angular acceleration of the boom, wherein the generating generates the command to the power controller for controlling the supply voltage supplied to the lifting magnet according to the detected change.

* * * * *